United States Patent [19]

Le Bozec

[11] 4,352,389

[45] Oct. 5, 1982

[54] DEVICE FOR THE ADJUSTABLE COUPLING OF AT LEAST ONE SIDE WALL OF A CHILL-MOLDING MACHINE TO ITS OPERATING MEMBER

[75] Inventor: Alain Le Bozec, Ivry, France

[73] Assignee: Etablissements A. Voisin, Puteaux, France

[21] Appl. No.: 147,159

[22] Filed: May 6, 1980

[30] Foreign Application Priority Data

Dec. 20, 1979 [FR] France ..... 79 31324

[51] Int. Cl.[3] ..... B22D 15/04; B22D 17/26

[52] U.S. Cl. ..... 164/343; 164/303

[58] Field of Search ..... 164/343, 344, 341, 342; 425/450.1, 451, 451.9

[56] References Cited

U.S. PATENT DOCUMENTS

| | | | |
|---|---|---|---|
| 3,263,277 | 8/1966 | Ohlendorf et al. | 164/343 X |
| 3,497,919 | 3/1970 | Brochetti | 164/343 X |
| 3,716,323 | 2/1973 | Classen | 164/343 X |

FOREIGN PATENT DOCUMENTS

| | | | |
|---|---|---|---|
| 2429570 | 1/1975 | Fed. Rep. of Germany | 164/343 |
| 1339379 | 8/1963 | France | 164/342 |
| 2112143 | 6/1972 | France | 164/342 |
| 366025 | 4/1973 | U.S.S.R. | 164/343 |

*Primary Examiner*—Nicholas P. Godici
*Assistant Examiner*—J. Reed Batten, Jr.
*Attorney, Agent, or Firm*—Shenier & O'Connor

[57] ABSTRACT

The invention relates, in a chill-molding machine, to an adjustable device for coupling the driving yoke of the side parts of a mold to a jack for operating this yoke. This device is constituted by a part fast to the rod of the jack mounted to slide in the transverse part of the yoke and immobilizable in this part by a clamp borne by the yoke. The invention has application in the foundry field.

2 Claims, 3 Drawing Figures

Figure 1:
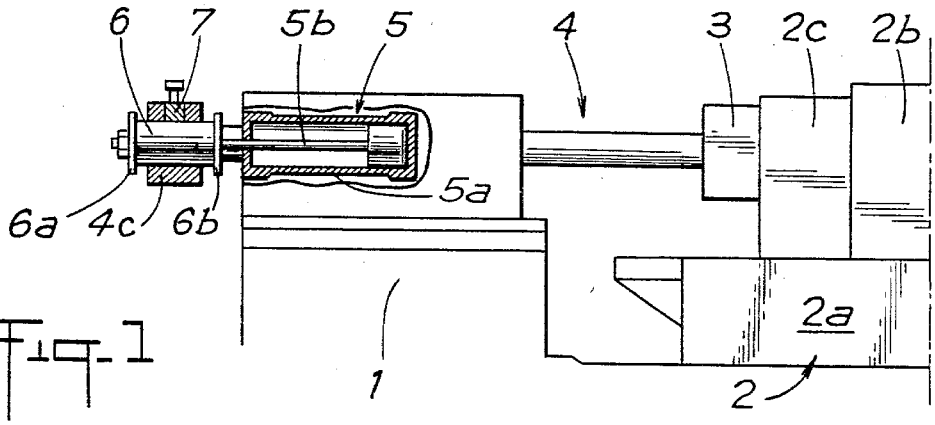

DEVICE FOR THE ADJUSTABLE COUPLING OF AT LEAST ONE SIDE WALL OF A CHILL-MOLDING MACHINE TO ITS OPERATING MEMBER

The invention relates to a device for the adjustable coupling of at least one side wall of a chill-molding machine to its operating member.

In a chill-molding or chill-casting machine, the mold is generally constituted by several elements assembled on a support bed or bed-plate. Certain of these elements and notably the side parts of the mold are movable with respect to the support bed in horizontal translation. To actuate their movements, on the opening and/or the closing of the mold, they are coupled to an operating member (generally the rod of a hydraulic jack).

The closing of the mold is effected when the side parts are placed in abutment with at least one fixed part (the sole-plate, for example) of the mold with respect to the bed-plate. This position correspnds to the end of the stroke of the rod of the hydraulic jack so that the hydraulic pressure is not entirely transmitted to said part in abutment. This adjustment is, in known manner, carried out once and for all on placing the machine in operation and generally does not take into account expansions to which the elements constituting the mold are subject so that, in normal operation, the closed position is reached before the rod of the jack has reached the end of its stroke. It follows that the side parts are flattened in abutment under the effect of the total hydraulic pressure which generates considerable forces at the level of the contact between the closed mold elements which can lead to a deformation of the impression by relative displacement of these elements.

It is an object of the invention to overcome this drawback by providing a simple coupling device between the side parts of the mold and their respective operating member which permits adjustment of the force with which the side parts of the mold are applied to the other fixed elements of the latter in the course of the operation of the chill-molding machine.

To this end, according to the invention there is provided, in a chill-molding machine comprising a support bed, notably for the different constituents of a mold and their operating members, an adjustable device for coupling each of the side parts of the mold to the corresponding operating member which is constituted by a hydraulic jack of which the body is fast to the support bed and of which the rod is coupled to a yoke fast to said side part. More precisely, one of the characteristics of the invention consists in that the above-said rod slidably passes through a transverse part of said yoke and includes at least one shoulder located between this transverse part and the body of the jack whilst a gripping clamp borne by said transverse part constitutes a means for the immobilisation of the rod with respect to said yoke. It is advantageous to provide a rod of sufficiently large diameter to have a sufficient bearing surface for the clamp, at least on its part sliding in the yoke.

Figure 2:
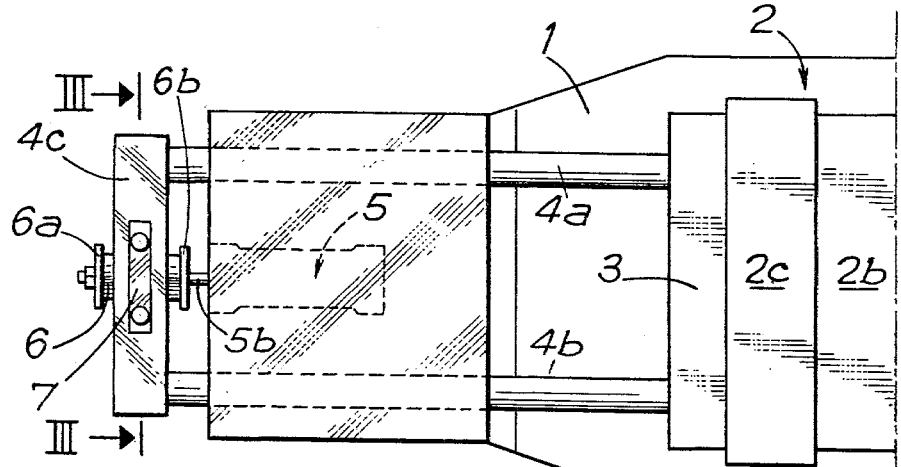
Figure 3:
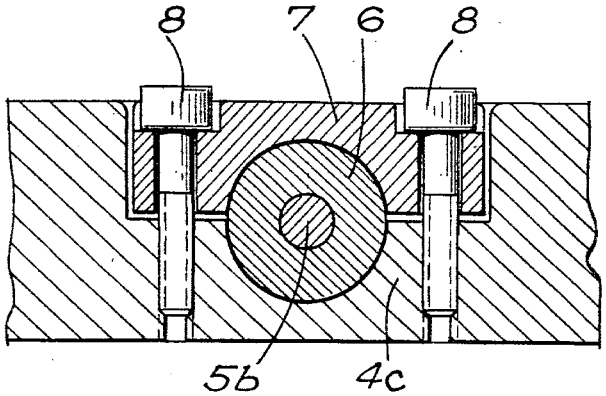

The invention will be better understood on reading the following description with reference to the accompanying drawings in which:

FIGS. 1 and 2 show by diagrams in elevation and in plan a chill-molding machine equipped with a device according to the invention; and FIG. 3 is a section along the line III—III of FIG. 2.

Referring to FIGS. 1 and 2, there is to be seen a support bed 1 (shown partially) of a chill-molding machine supporting a mold 2 constituted by assembled elements 2*a* to 2*c*. Certain of these elements 2*a* are fixed with respect to the support bed 1 of the machine whilst others are movable (2*b* and 2*c*) either vertically upwards (2*b*), or horizontally and laterally (2*c*) to enable the opening of the mold 2 and the lifting or stripping of the part.

The side element or part 2*c* is coupled to a mold-carrier 3, in known manner, which is itself fast to a yoke 4 including two longitudinal parts 4*a*, 4*b* and a transverse part 4*c*. This yoke is supported slidably by the support bed 1. Between the transverse part 4*c* and said support bed extends an operating member of the yoke 4 constituted by a hydraulic jack 5 of which the cylinder 5*a* is fast to the support bed whilst the rod 5*b* is coupled to said transverse part 4*c*.

At its end for coupling with the part 4*c*, the rod 5*b* is provided with a part 6 of greater diameter which includes two shoulders 6*a* and 6*b* extending on both sides of the transverse part 4*c*. Part 6 is mounted slidably in the part 4*c* of the yoke. A clamp 7 for gripping said part 6 in its sliding bearing enables the yoke 4 to be immobilised with respect to the rod 5*b* of the jack. This clamp is better seen in FIG. 3. Tightening means are constituted by the screws 8.

The invention is operated in the following manner. When the mold is closed (FIG. 1), the screws 8 are loosened, and the separation of the side part 2*c* of the mold is actuated by supplying the jack 5. The drawing of the yoke by the rod 5*b* is effected by means of the shoulder 6*b*. The mold then being opened and the piston of the jack 5 at a stroke end toward the left of FIG. 1, the screws 8 are tightened and the closing of the mold is actuated. When the part 2*c* arrives in abutment on the parts 2*a* and 2*b* of the mold, the piston has not reached its end of stroke limit towards the right in the cylinder 5*a* and the part 2*c* transmits the whole force of the jack to the other elements of the mold. At this moment, the screws 8 are again loosened so as to release the part 6 in the yoke so that the piston can reach this stroke end. It is possible at this moment to unscrew more or less the said screws 8 and the sliding of the part 6 is more or less frictional. In this way a more or less considerable flattening force of the part 2*c* on the rest of the mold is maintained. It is advantageous to be able to benefit from a considerable range of variation of friction, to provide a large contact surface between the clamp 7 and the part 6, hence to have a part 6 of the largest possible diameter and in any event well above the diameter of the rod 5*b* proper. When the righthand stroke end position is reached by the piston, the screws 8 are again tightened.

By this simple means, an accurate adjustment of the stroke of the side parts of the mold and of the force to which they are subjected in the mold-closed position is obtained. This adjustment enables intervention at any moment on the mold and notably, after a first cold adjustment, when the mold has reached its operating temperature.

The invention finds useful application in the foundry field.

It is not limited to the description which has just been given but covers, on the contrary, all modifications which could be introduced therein without departing from its scope or from its spirit. In particular, this device describes the invention with regard to a single side part which can be applied to all the movable parts of the mold manipulated by means of a hydraulic jack.

What is claimed is:

1. In a chill-molding machine having a support bed for the fixed and movable parts of the mold and a hydraulic jack the body of which is secured to the bed and having a rod for moving one of said movable parts with respect to said fixed parts, a device for adjustably coupling said one movable part to said hydraulic jack including a yoke secured to said one movable part, said yoke having a transverse part formed with an opening through which said jack rod extends for sliding movement relative to said transverse part of said yoke, a shoulder on said rod between said transverse part and the body of the jack, and a gripping clamp carried by said transverse part for immobilizing said rod with respect to the transverse part of the yoke.

2. A device as in claim 1 in which the portion of said rod slidable in the transverse part of the yoke is of appreciably greater diameter than the remainder of the rod whereby to offer sufficient bearing surface for said clamp.

* * * * *